US006679555B2

(12) United States Patent
Bangert

(10) Patent No.: US 6,679,555 B2
(45) Date of Patent: Jan. 20, 2004

(54) ADJUSTING DEVICE FOR A PIECE OF FURNITURE ON WHICH TO LIE OR FOR SITTING ON WITH AT LEAST ONE SWIVEL PART THAT IS PIVOTALLY ATTACHED, BY WAY OF A TORSION BAR, TO SAID PIECE OF FURNITURE ON WHICH TO LIE OR FOR SITTING ON

(76) Inventor: Christian Bangert, Bismarckstrasse 150, Aachen (DE), D-52066

( * ) Notice: Subject to any disclaimer, the term of this patent is extended or adjusted under 35 U.S.C. 154(b) by 139 days.

(21) Appl. No.: 09/962,984

(22) Filed: Sep. 24, 2001

(65) Prior Publication Data

US 2002/0036421 A1 Mar. 28, 2002

(30) Foreign Application Priority Data

Sep. 22, 2000 (DE) ..... 100 47 037

(51) Int. Cl.[7] ..... A47C 1/02; B60N 2/02; A47B 7/02

(52) U.S. Cl. ..... 297/316; 297/362.14; 297/330; 5/616; 5/618

(58) Field of Search ..... 297/362.14, 86, 297/316, 330; 5/616, 618; 74/89.32, 89.34, 89.14

(56) References Cited

U.S. PATENT DOCUMENTS

| | | | | | |
|---|---|---|---|---|---|
| 3,191,196 | A | * | 6/1965 | Holm | 5/616 |
| 3,300,794 | A | * | 1/1967 | Altorher | 5/616 |
| 5,063,623 | A | * | 11/1991 | Bathrick et al. | 5/616 |
| 5,075,911 | A | * | 12/1991 | Dewert | 5/616 |
| 5,095,562 | A | * | 3/1992 | Alexander | 5/616 |
| 5,568,661 | A | * | 10/1996 | Bathrick et al. | 5/618 |
| 5,675,849 | A | * | 10/1997 | Koch | 5/616 |
| 6,269,707 | B1 | * | 8/2001 | Koch | 74/89.23 |

FOREIGN PATENT DOCUMENTS

| | | | | |
|---|---|---|---|---|
| DE | 38 42 078 C2 | | 7/1992 | |
| DE | 19718255 C1 | * | 9/1998 | A47C/00/00 |
| EP | 0 372 032 B1 | | 5/1992 | |

* cited by examiner

*Primary Examiner*—Peter M. Cuomo
*Assistant Examiner*—Sarah C. Burnham
(74) *Attorney, Agent, or Firm*—Thomas R. Vigil; Welsh & Katz, Ltd.

(57) ABSTRACT

An adjusting device for a piece of furniture on which to lie or for sitting on with at least one swivel part (12, 14) that is pivotally attached, by way of a torsion bar (20, 22), to the piece of furniture on which to lie or for sitting on, with a housing (26) and with a bearing element (38, 40) accommodated in the housing (26) whereas the bearing element (38, 40) is provided with a recess (66, 68) that partially surrounds the torsion bar (20, 22) and in which the torsion bar (20, 22) may be introduced so that the adjusting device (24) is attached to the torsion bar (20, 22) with positive fit, and with an actuating drive (46, 48) that is accommodated in the housing (26) and acts on the torsion bar (20, 22). The bearing element is connected to the actuating drive (46, 48) which are slidably arranged in the housing (26). The actuating drive is in position to engage and push an end (34, 36) of a lever arm (30, 32) radially projecting from and fixed to the torsion bar (20, 22) and received in the housing (26) thereby to place a torgue on the torsion bar (20, 22) which pushes the torsion bar (20, 22) into the recess (66, 68).

11 Claims, 8 Drawing Sheets

ADJUSTING DEVICE FOR A PIECE OF FURNITURE ON WHICH TO LIE OR FOR SITTING ON WITH AT LEAST ONE SWIVEL PART THAT IS PIVOTALLY ATTACHED, BY WAY OF A TORSION BAR, TO SAID PIECE OF FURNITURE ON WHICH TO LIE OR FOR SITTING ON

CROSS-REFERENCE TO RELATED APPLICATIONS

This application claims priority from German Application No. DE 100 47 037.8-16 filed Sep. 22, 2000.

The present invention relates to an adjusting device for a piece offurniture on which to lie or for sitting on with at least one swivel part that is pivotally attached, by way of a torsion bar, to said piece of furniture on which to lie or for sitting on, with a housing and with a bearing element accommodated in said housing, wherein the bearing element is provided with a recess that partially surrounds the torsion bar and in which said torsion bar may be introduced so that the adjusting device is attached to the torsion bar with positive fit, and with an actuating drive that is lodged in the housing and acts on the torsion bar.

The European Patent No. 372 032 B1 discloses an adjusting device for a supporting framework of a bed that is equipped with at least one pivotal backrest part and one privotal leg part, a torsion bar that extends into the adjusting device being provided at the respective one of the backrest and leg parts. A radially projecting erection lever that acts on a spindle of an actuating drive is arranged at said torsion bar. Said adjusting device comprises a housing in which all of the components that are necessary for adjusting the headrest part and the leg part are incorporated. In said housing, one recess is provided for the respective one of the leg and headrest parts, said recess receiving that part of the torsion bar that comprises the erection lever. To fasten the adjusting device to the supporting framework, the housing with its recess is pushed from the bottom onto the torsion bars in such a manner that the erection lever disappears into the housing and that the torsion bar abuts in the recess. Then, a cover attached to the housing is pushed over the recess so that the housing and the entire adjusting device are kept suspended from the torsion bar, and accordingly from the supporting framework, by way of said cover. In the housing, one actuating drive is provided for each torsion bar, the spindle of said actuating drive pushing the erection lever, thus moving the headrest part or the leg part respectively into the desired position.

The German Patent No. 38 42 078 C2 suggests a drive for adjusting the headrest part and the leg part of a supporting framework in the multipartite housing of which one actuating drive is provided for each torsion bar, the spindle of said actuating drive pushing a corresponding erection lever arranged on the torsion bar, the actuating drive thus being capable of moving the headrest part or the leg part into the desired position. To fasten the drive to the torsion bars, and accordingly to the supporting framework, two clamp-like springs are provided for each torsion bar, the properties of said springs being such that they can be urged so far to the side that the torsion bar may be introduced into the spring and that the springs to partially encircle said torsion bar in order to thus keep the adjusting device in a positive fit at the torsion bars and at the supporting framework respectively.

The adjusting devices disclosed in the European Patent No. 372 032 B1 and in the German Patent 38 42 078 C2 are attached to the supporting framework without additional fastening means in that they are simply hung to the respective one of the torsion bars. For this purpose, it is advantageous to realize the adjusting device with as little weight as possible. To arrange the known adjusting devices to the supporting framework, the torsion bars must first be introduced into the corresponding recesses or clamps respectively before the cover may be pushed into position to close the recess. This assembly is very complicated and can only be performed by skilled staff, all the more because there is only very little place available underneath the supporting framework. Moreover, these adjusting devices are expensive to manufacture on account of the number and the size of their component parts.

In view thereof, the object of the present invention is to provide an adjusting device that can be readily mounted to the piece of furniture and whose cost of production is low.

According to the invention, the technical solution to this object is to suggest an adjusting device with the features of claim 1. Advantageous developments of this adjusting device will become apparent in the subordinate claims.

An adjusting device realized in accordance with this technical teaching has the advantage that it may be readily mounted on account thereof. For this purpose, the housing is at first simply suspended to the torsion bar by means of the recess, then, the actuating drive pushes the torsion bar into the recess so that the bearing element encompasses the torsion bar in the region of the recess. As a result thereof, the adjusting device is hung to the supporting framework with positive fit so that there is no longer the need for the irksome closing of the cover or for the arrangement of other fastening elements. It is thus also made certain that the adjusting device is permanently held on the torsion bar, i.e. on the supporting framework.

In a preferred development, the recess opens toward the actuating drive so that the adjusting device may be pushed onto the torsion bar in an almost horizontal direction and that an arm, which forms the recess, rests on the torsion bar, thus holding the entire adjusting device. Another advantage is that the bearing element is connected to the actuating drive so as to resist tensile strength, the actuating drive being thus capable of always tightly pulling the bearing element to the torsion bar so that the recess durably and reliably encompasses the torsion bar with its web.

In another preferred embodiment the adjusting device comprises a pushing element that may be traveled across the torsion bar and that exerts a pressure onto the torsion bar by way of the actuating drive. This also causes the torsion bar to be pushed into the recess of the bearing element so that the torsion bar is prevented from slipping out of the recess and, accordingly, the adjusting device from falling down. This is achieved in a particularly advantageous manner in that an erection lever that projects radially and reaches into the housing is arranged on the torsion bar, said erection lever transmitting the forces generated by the pushing element onto the torsion bar.

In a particularly preferred embodiment, all of the features mentioned herein above have been realized in the adjusting device. This has the great advantage that, on one side, the bearing element is pulled by the pulling force over the torsion bar located in the recess and that, on the other side, the pushing element and the erection lever cause a force of pressure to act onto the torsion bar, said force also pushing the torsion bar into the recess of the bearing lever. This combined action of pulling and pushing forces guarantees that the torsion bar always remains in the recess even though the torques that are necessary for pivoting the headrest part and/or the leg part are applied to the torsion bar by means of the actuating drive. There is thus provided in a simple way an adjusting device that is reliable and easy to install and that can be realized with particularly inexpensive component parts.

Another advantage is that, as a result thereof, the spindle located in the actuating drive is loaded in tension and can thus be designed to have a much smaller size since the material is capable of regularly absorbing higher pulling and pushing loads. It ensues that the spindle can be designed to be hollow, which saves not only material but also weight. Accordingly, the electric motor required and other component parts may be designed in a smaller size, which reduces costs. Above all, such a hollow spindle made from a synthetic material can be manufactured at lower cost since the cooling times in the injection molding machine used to manufacture the hollow spindle can be shorter on account of the reduced thickness of the material.

In another preferred embodiment, the actuating drive, the bearing element and the pushing element form an adjusting mechanism that is axially slidably carried in the housing. This makes it easier to introduce the torsion bar, since the entire mechanism can be slightly shifted for this purpose and is brought back to its initial position once the torsion bar has been introduced.

In another preferred embodiment, two adjusting mechanisms are accommodated in one single housing so that both the headrest part and the leg part may be adjusted by means of one unique adjusting device.

Further advantages of the adjusting device according to the invention will become apparent in the accompanying drawing and in the following description of embodiments. The features mentioned herein above and those still to be discussed can be used in accordance with the invention either separately or in any combination. The mentioned embodiments are to be considered only as illustrative and not restrictive.

Figure 1:
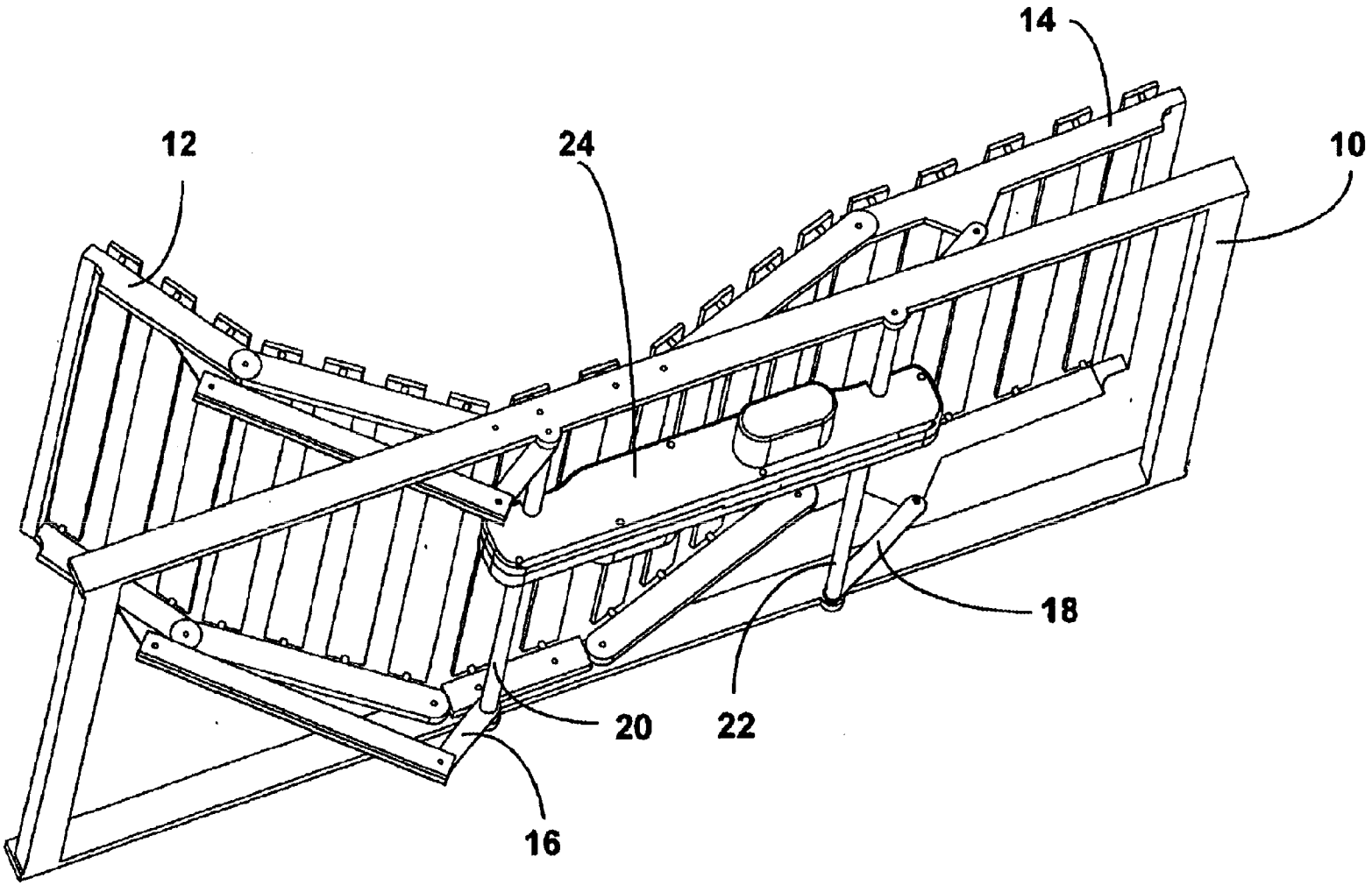
FIG. 1 is a perspective view of a supporting framework of a bed with an adjustable headrest part and leg part and with an adjusting device in accordance with the invention.

FIG. 3*a–f* shows various positions of the opened adjusting device of FIG. 1 together with the corresponding positions of the swivel part during installation thereof on a supporting framework.

FIG. 1 shows a supporting framework 10 of a bed with pivotally arranged headrest and leg parts that are provided with a swivel part 12, 14, which is equipped with laths and is rotatably carried on the supporting framework 10, and that may be pivoted by a torsion bar 20, 22 which is rotatably carried on the supporting framework 10 by way of levers 16, 18 that act on the swivel part 12, 14. An embodiment of an adjusting device according to the invention that will be described in detail in the following Figures is hung to these two torsion bars 20, 22 so that it is fixed at one end only. Said adjusting device 24 is merely suspended to the torsion bars 20, 22 and needs no further fastening means so that this adjusting device 24 may also be readily retrofitted to already existing supporting frameworks 10.

Figure 2:
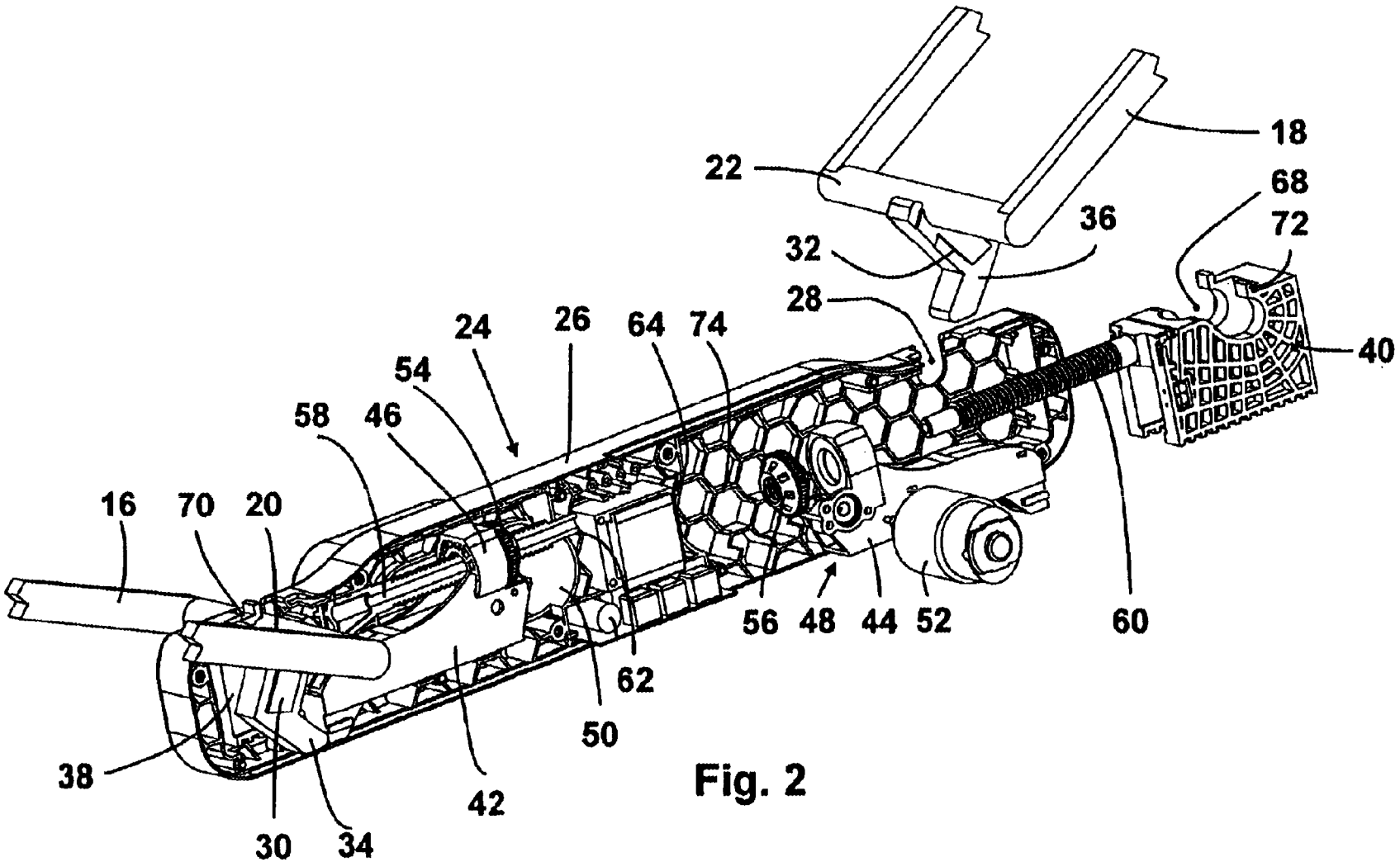
FIG. 2 is an exploded view of an opened adjusting device according to FIG. 1.

As can be surveyed from FIG. 2, the adjusting device 24 comprises a bipartite housing 26 in which two adjusting mechanisms of identical construction are accommodated so as to be axially slidable. The illustration represented in FIG. 2 merely shows one part of the housing 26, whereas the other, absolutely identical part of the housing 26 is not represented. Altogether four recesses 28, in which the respective one of the torsion bars 20, 22 may be introduced, are provided in the housing 26. Said recesses 28 have been chosen and dimensioned to be capable of easily receiving the torsion bars 20, 22 without these bordering on the housing 26.

A radially projecting erection lever 30, 32, which is angular in shape, is arranged on the torsion bar 20, 22. The erection lever 30, 32 with its angular web 34, 36, which is fastened to the torsion bar 20, 22 by being incorporated into the material, is directed toward the center of the adjusting device 24.

The adjusting mechanism comprises a bearing element 38, 40, a pushing element 42, 44, and an actuating drive 46, 48. An electric motor 50, 52, a worm wheel 54, 56 driven by said electric motor 50, 52 and a hollow spindle 58, 60 that is driven by the worm wheel, is integral with the bearing element 38, 40 and is held axially slidable by its free end in a bearing opening 62, 64 into which it fits snugly are all part of the actuating drive 46, 48. The pushing element 42, 44 is also axially slidably guided on the hollow spindle 58, 60 and is given such an elongated shape that its front edge pushes onto the angular web 34, 36 of the erection lever 30, 32.

A recess 66, 68, whose opening is directed toward the center of the housing 26 and into which the torsion bar 20, 22 may be introduced, is realized on the upper side of the bearing element 38,40. A projection 70, 72 realized on the upper side of the bearing element 38, 40 partially encompasses the torsion bar 20, 22 so that, as a result thereof, the adjusting device 24 may be form-fittingly hung on the torsion bar 20, 22.

Once mounted, the actuating drive 46, 48 attracts the hollow spindle 58, 60 and the bearing element 38, 40 that is integral with the hollow spindle 58, 60 in such a manner that the torsion bar 20, 22 that has been introduced into the recesses 28 and 66, 68 is encompassed by the projection is 70, 72 so that the adjusting device 24 is thus positively maintained on the torsion bar 20, 22. Concurrently, the pushing element 42, 44 exerts through the web 34, 36 and the erection lever 30, 32 a pressure onto the torsion bar 20, 22 causing it to also be pressed into the recess 66, 68 and to be encompassed by the projection 70, 72 in such a manner that the adjusting device 24 is positively maintained on the torsion bar 20, 22 on account of this exerted pressure as well. Simultaneously, the pushing element 42, 44 exerts through the web 34, 36 and the erection lever 30, 32 a torque onto the torsion bar 20, 22, thus causing the swivel part 12, 14 to move accordingly.

If the electric motor 50, 52 is attracted, the swivel part 12, 14 is pivoted into the corresponding position by way of a corresponding pressure exerted onto the erection lever 30, 32. If the electric motor 50, 52 is moved back, the pressure on the erection lever 30, 32 decreases so that the deadload of the swivel part 12, 14 causes it to move back downward. During this procedure, the pushing element 42, 44 is always under pressure whereas the hollow spindle 58, 60 and the bearing element 38, 40 are always loaded in tension.

The torsion bar 20, 22 is reliably held in the recess 66, 68 on account of this alternation of pulling and pushing forces so that the projections 70, 72 always project beyond the torsion bar 20, 22, thus positively and reliably maintaining the adjusting device 24 on the torsion bars 20, 22. This is also and particularly true during the pivoting process.

In the embodiment of an adjusting device 24 in accordance with the invention as it is illustrated herein the two adjusting mechanisms are equipped with exactly the same component parts. As aresult thereof there is no need for unnecessary forming tools, the number of pieces to be produced increases accordingly so that the various parts may be manufactured at low cost. However, this leads to the fact that the electric motor 50, 52 that acts on the worm wheel 54, 56 projects once to the right and once to the left, so that a respective corresponding bight portion is provided in the housing 26. As a result thereof, the two parts of the housing 26 may be identical, which also reduces the cost of production.

The complete adjusting mechanism is carried in the housing, so as to be slidable in direction of the hollow spindle 58, 60. For this purpose, the inner side of the housing, 26 is given a honeycombed stiffening structure that concurrently serves to guide the respective one of the adjusting mechanisms. Moreover, the hollow spindle 58, 60 is also maintained in the bearing opening 62, 64 so as to be axially slidable, wherein the end of the hollow spindle 58, 60 is given a length that corresponds to the sliding path and that causes the hollow spindle 58, 60 to always remain in the bearing opening 62, 64.

Figure 3A:
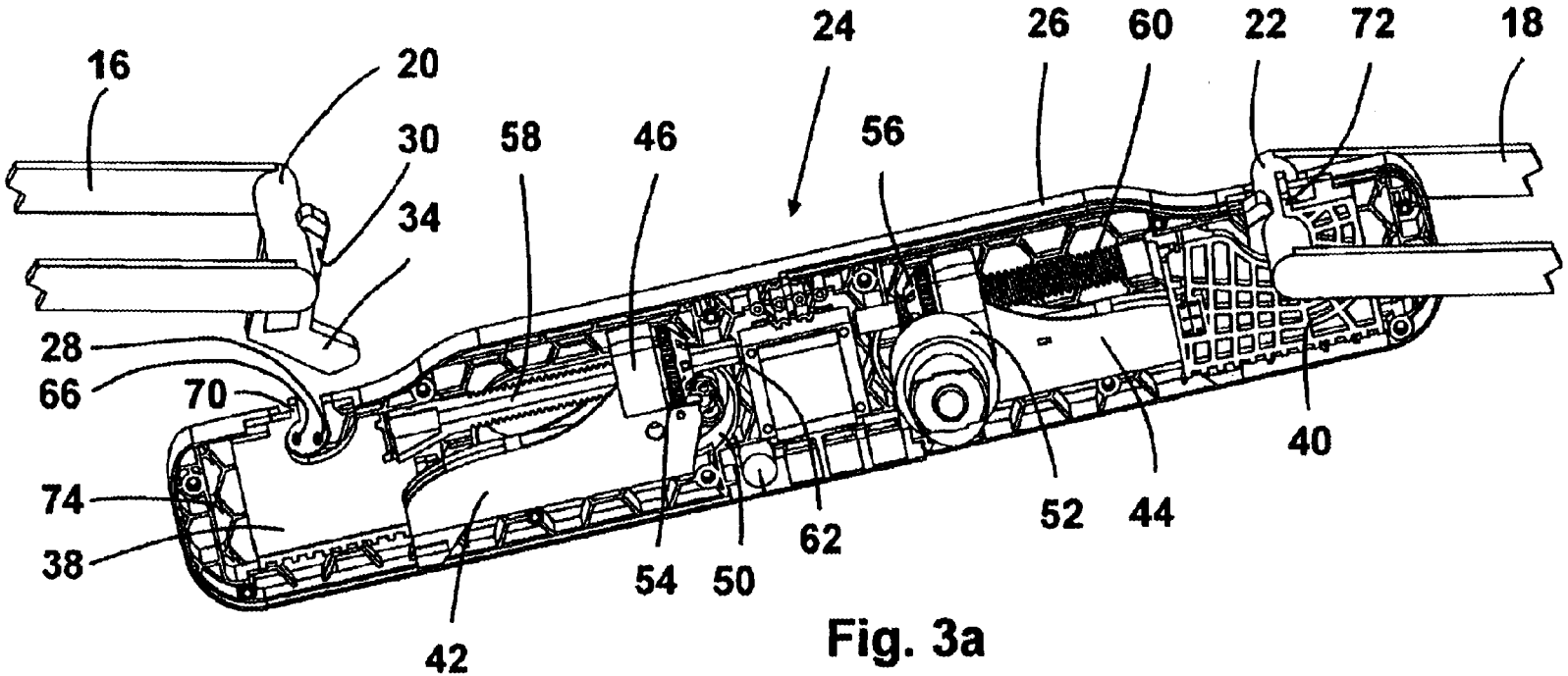
Figure 3B:
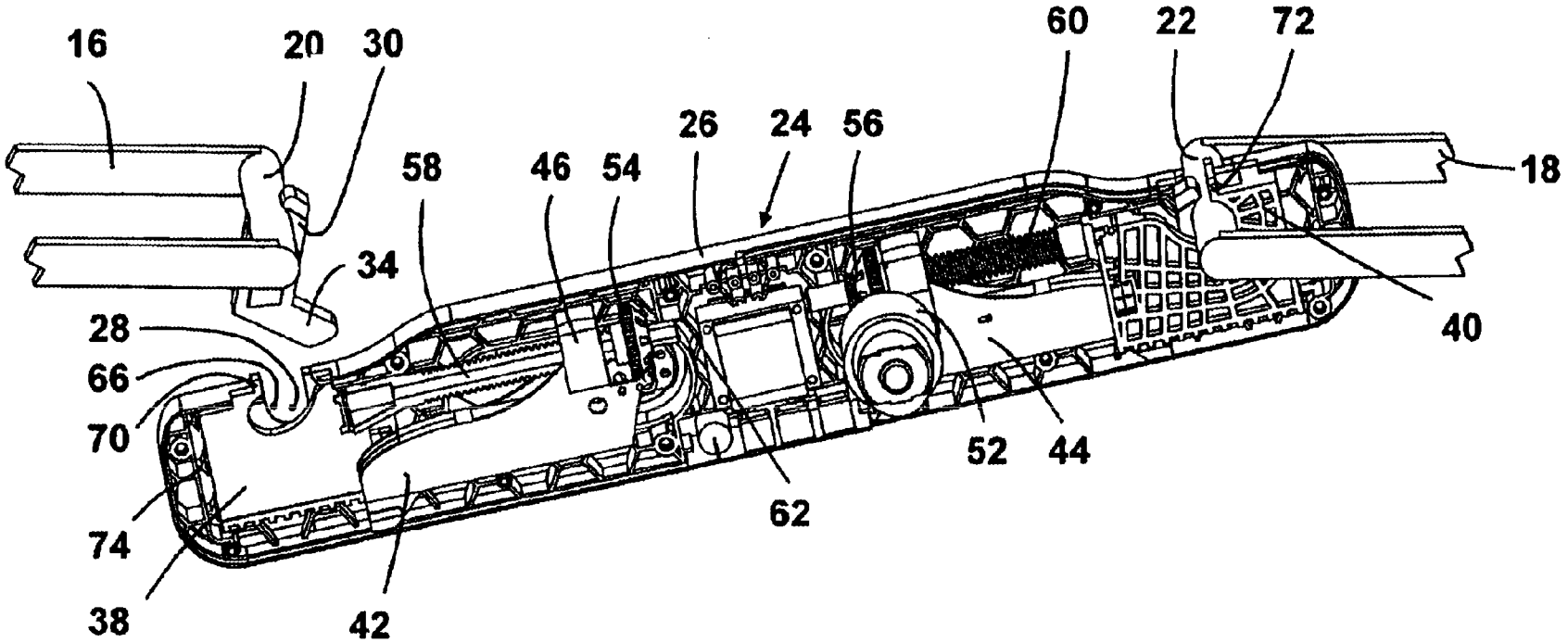
Figure 3C:
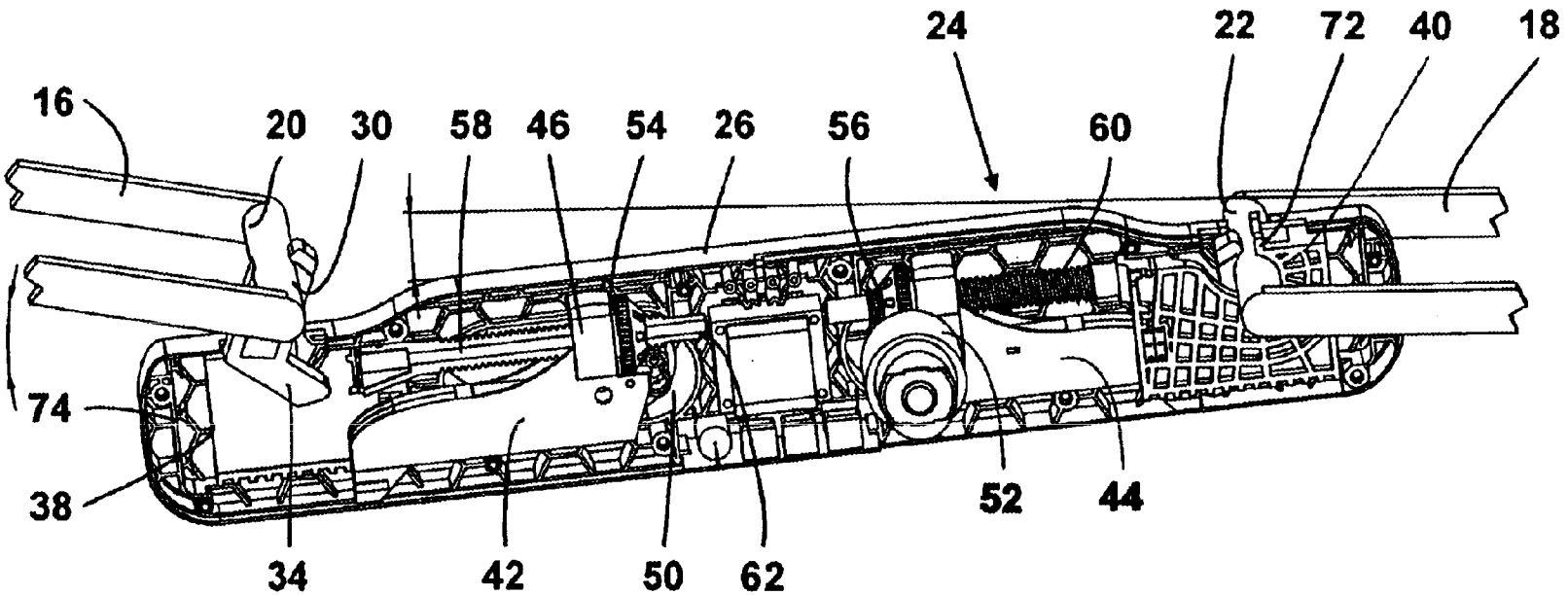
Figure 3D:
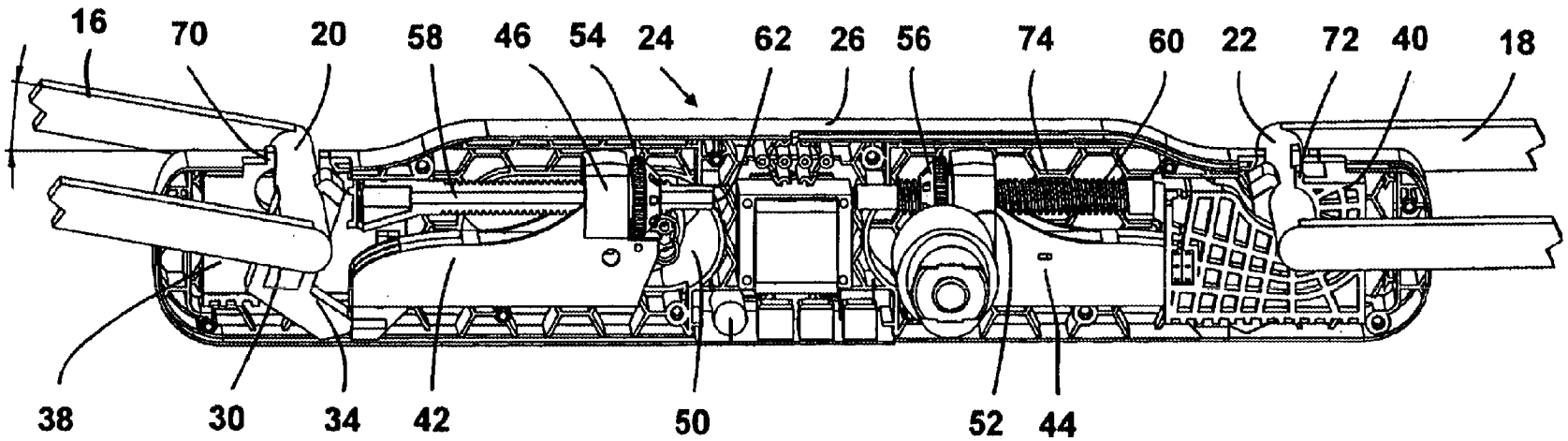
Figure 3E:
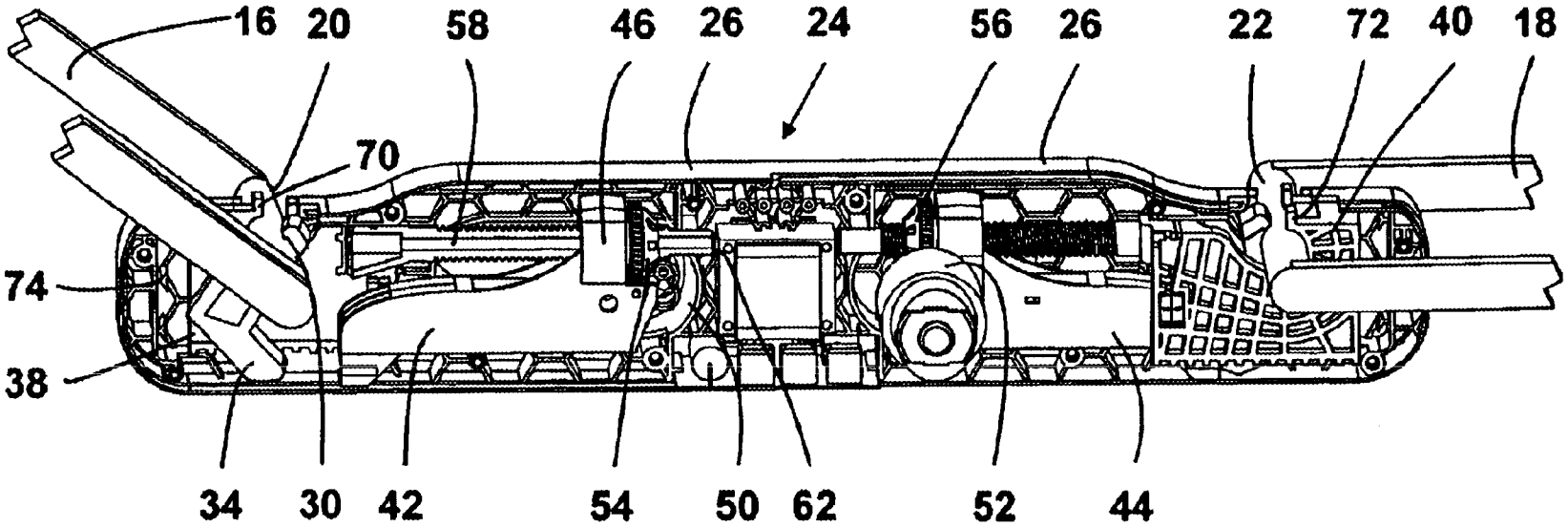
Figure 3F:
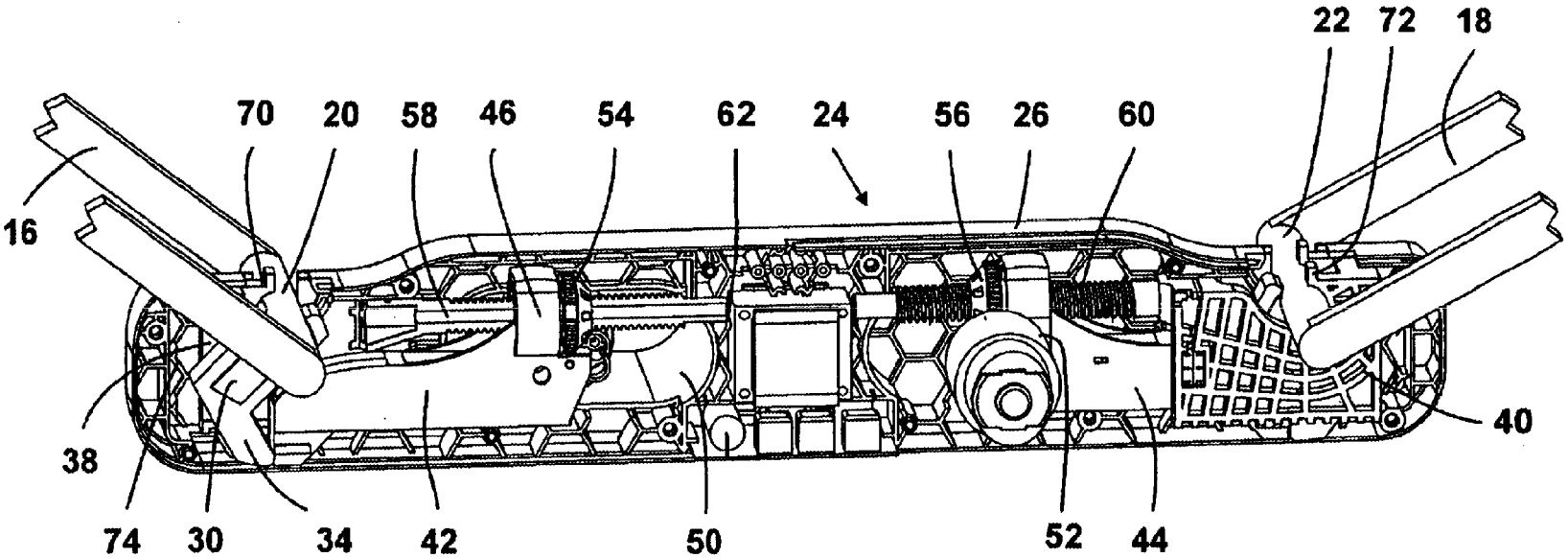

The arrangement of the adjusting device 24 to the torsion bars 20, 22 is carried out in several subsequent steps that are illustrated in the FIGS. 3*a* through 3*f*. The adjusting device 24 is thereby already suspended by one side on the torsion bar 22, whereas FIG. 3*a* shows the other adjusting mechanism which is still in its initial position. Because of the slant position of the adjusting device 24, the entire adjusting mechanism glides by gravity so far towards the outer end of the housing 26 that the bearing element 38 comes to rest on the honeycomb 74. This position is shown in FIG. 3*b*. Now, the bearing element 38 has been shifted axially to such an extent that the projection 70 completely frees the recess 28 so that now, the torsion bar 20 may be introduced into the recess 28 and into the recess 66. For this purpose, the swivel part 16 is slightly raised so that the web 34 may first be introduced into the recess 28 of the housing 26 by causing the adjusting device 24 to move upward toward the supporting framework. As soon as the web 34 has been introduced into the housing 26, the swivel part 16 is brought back into its initial position and the adjusting device 24 is further moved upward so that the torsion bar 20 also enters the recess 28; this is represented in the FIGS. 3*c* and 3*d*. The torsion bar 20 thereby contacts the curved recess 66 of the bearing element 38 and pushes the bearing element 38 together with the complete adjusting mechanism to the side so that said adjusting mechanism moves toward the center of the adjusting device 24 (FIG. 3*e*). The projection 70 thereby: encompasses the torsion bar 20, thus locking the adjusting device 24 to the torsion bar 20. Now, the adjusting device 24 is positively held on the torsion bar 20 and can be used in accordance with its intended purpose, As shown in FIG. 3*f*, a pressure may now be exerted by way of the pushing element 42 onto the erection lever 34 by actuating the actuating drive so that the lever 16 pushes the swivel part 12 into the desired position.

As soon as the electric motor 50 rotates the worm wheel 54 back, the pushing element 42 is relieved so that the dead load of the swivel part 12 pushes the pushing element 42 back by way of the lever 16, the torsion bar 20 and the erection lever 30.

List of Numerals

10 supporting framework
12 swivel part
14 swivel part
16 lever
18 lever
20 torsion bar
22 torsion bar
24 adjusting device
26 housing
28 recess
30 erection lever
32 erection lever
34 web
36 web
38 bearing element
40 bearing element
42 pushing element
44 pushing element
46 actuating drive
48 actuating drive
50 electric motor
52 electric motor
54 worm wheel
56 worm wheel
58 hollow spindle
60 hollow spindle
62 bearing opening
64 bearing opening
66 recess
68 recess
70 projection
72 projection
74 honeycomb

What is claimed is:

1. An adjusting device for a piece of furniture on which to lie or for sitting on with at least one swivel part (12, 14) that is pivotally attached, by way of a torsion bar (20, 22), to said piece of furniture on which to lie or for sitting on, with a housing (26) and with a bearing element (38, 40) accommodated in said housing (26), said bearing element (38, 40) being provided with a recess (66, 68) that partially surrounds the torsion bar (20, 22) and in which said torsion bar (20, 22) may be introduced so that the adjusting device (24) is attached to the torsion bar (20, 22) with positive fit, and with an actuating drive (46, 48) that also is accommodated in the housing (26) and acts on the torsion bar (20, 22), characterized in that the bearing element (38, 40) arranged in the housing is connected to the actuating drive (46, 48) in the housing with tensile strength so that the actuating drive (46, 48) pulls the bearing element (38, 40) against the torsion bar (20, 22) thereby to push the torsion bar (20, 22) into the recess (66, 68) without placing any significant force on the housing (26) whereby the housing (26) can be made of lightweight material.

2. The adjusting device of claim 1, characterized in that the recess (66, 68) opens toward the actuating drive (46, 48).

3. The adjusting device of claim 1, characterized in that said actuating drive (46, 48) includes a pushing element (42, 44) that is arranged in the housing (26) in position to engage and push an end (34, 36) of (20, 22), that is driven by the actuating drive (46, 48) and that is slidable across the torsion bar (20, 22), the pushing element (42, 44) being loaded in pressure between the torsion bar (20, 22) and the actuating drive (46, 48).

4. The adjusting device of claim 3, characterized in that the radially projecting lever arm (30, 32) fixed on the torsion bar (20, 22) reaches into the housing (26) and the pushing element (42, 44) acts on the end (34, 36) of said lever arm (30, 32).

5. The adjusting device of claim 1, characterized in that the actuating drive (46, 48) is provided with a hollow spindle (58, 60) that is preferably loaded in tension.

6. The adjusting device of claim 5, characterized in that the hollow spindle (58, 60) is attached by one side in a bearing opening (62, 64) in such a manner that it is axially slidable.

7. The adjusting device of claim 1, characterized in that the actuating drive (46, 48), the bearing element (38, 40) and the pushing element (42, 44) form an adjusting mechanism that is axially slidably carried in the housing (26).

8. The adjusting device of claim 7, characterized in that two adjusting mechanisms for pivoting two torsion bars (20, 22) are provided in one single housing (26).

9. The adjusting device of claim 1 characterized in that said bearing element (38, 40) has, at a side of the recess (66, 68) facing toward the center of the housing (26), a projection (70, 72) that extends toward the center of the housing (26) to assist in encompassing and holding the torsion bar (20, 22) in the recess (66, 68) in the bearing element (38, 40).

10. The adjusting device of claim 9 characterized in that said bearing element (38, 40) has, at a side of the recess (66, 68) opposite the projection (70, 72), a rounded or curved surface for facilitating entry of the torsion bar (20, 22) into the recess (66, 68).

11. The adjusting device of claim 2 characterized in that said recess (66, 68) extends into said bearing element (38, 40) at an inclined downward angle and toward one end of the housing (26).

* * * * *